US006863999B1

(12) United States Patent
Sudre et al.

(10) Patent No.: US 6,863,999 B1
(45) Date of Patent: Mar. 8, 2005

(54) MONAZITE-BASED THERMAL BARRIER COATINGS

(75) Inventors: Olivier H. Sudre, Thousand Oaks, CA (US); David B. Marshall, Thousand Oaks, CA (US); Peter E. D. Morgan, Thousand Oaks, CA (US)

(73) Assignee: Innovative Technology Licensing, LLC, Thousand Oaks, CA (US)

( * ) Notice: Subject to any disclaimer, the term of this patent is extended or adjusted under 35 U.S.C. 154(b) by 0 days.

(21) Appl. No.: 10/057,184

(22) Filed: Jan. 23, 2002

(51) Int. Cl.[7] ..... F03B 3/12; B32B 9/06

(52) U.S. Cl. ..... 428/704; 428/697; 428/699; 428/701; 428/702; 416/241 B

(58) Field of Search ..... 428/469, 472, 428/472.1, 472.2, 697, 699, 701, 702, 704; 416/241 B

(56) References Cited

U.S. PATENT DOCUMENTS 5,665,463 A * 9/1997 Morgan et al.
5,698,022 A * 12/1997 Glassman et al.
5,759,632 A * 6/1998 Boakye et al.
5,858,465 A * 1/1999 Hunt et al.
6,190,780 B1 * 2/2001 Shoji et al.
6,200,672 B1 * 3/2001 Tadokoro et al.
6,235,370 B1 * 5/2001 Merrill et al.

* cited by examiner

*Primary Examiner*—Jennifer McNeil
(74) *Attorney, Agent, or Firm*—Liner Yankelevitz Sunshine and Regenstreif, LLP

(57) ABSTRACT

Monazites and xenotimes are rare-earth phosphates showing a combination of properties expected to be suitable for thermal barrier coatings. For example, lanthanum phosphate (La-monazite) can be used to form thermal barrier coatings to protect superalloy and ceramic parts exposed to high temperature and damage by sulfur, vanadium, phosphorus and other contaminants. The monazite or xenotime coatings can be applied using any of the common application methods including EB-PVD, laser ablation and plasma spraying. The stoichiometry of the coatings can be modulated according to the stoichiometry of specially prepared starting target (source) material. The most effective coatings appear to be largely crystalline and show a columnar structure with feather-like microstructure. For La-monazite, effective coatings between 10 and 500 micrometers in thickness can be deposited on substrates having temperatures between about 750° C. and about 950° C.

35 Claims, 2 Drawing Sheets

MONAZITE-BASED THERMAL BARRIER COATINGS

This invention was made with U.S. Government support under Contracts Nos. N00014-98-C-0210 and N00014-99-1-0471 awarded by the Office of Naval Research. The U.S. Government has certain rights in this invention.

BACKGROUND OF THE INVENTION

1. Area of the Art

The present invention is in the field of thermal barrier coatings used to protect machine parts, in particular engine components subjected to high temperature and corrosive atmospheres.

2. Description of the Prior Art

Many important machine parts-especially turbine engine parts-are exposed to high temperatures and corrosive atmospheres. It is necessary to provide some type of coating to protect these parts from premature wear and erosive or corrosive damage. These coatings are needed both for thermal insulation and environmental protection of engine and similar components. Different types of materials require different types of barrier coatings. Currently, thermal barrier coatings based on zirconium oxide ($ZrO_2$) are used widely in commercial airline, aerospace and power generating engines to raise the safe operating temperatures and improve the lifetimes of metallic components (4, 21, 28, 6, 33). Environmental barrier coatings for non-metallic silicon carbide (SiC), mostly based on refractory silicates, have been the subject of intense development recently, following the realization that lifetimes of SiC components in combustion environments are limited not only by oxidation but also by corrosion from water vapor (29, 25, 26).

Coatings for Metallic Parts

Nickel-based superalloy (as well as iron-based and cobalt-based superalloy) components are frequently coated with low conductivity yttria-stabilized zirconium oxide of thickness of the order 100–200 $\mu$m. An intermediate layer of aluminum oxide ($Al_2O_3$) (~1–4 $\mu$m thickness) is formed between the zirconia and a bonding layer which ensures bonding to the underlying metal (typically a superalloy). (29) The zirconia layer has low thermal conductivity (which may be reduced further by designed porosity and cracking). Zirconia is chosen almost universally for the outer layer because of its low thermal conductivity, high-temperature stability and corrosion resistance. The $Al_2O_3$ layer and bond coat protect the underlying superalloy from oxidation, the transport of oxygen through the zirconia layer, both by ionic diffusion and by diffusion through microcracks and voids being very rapid at typical combustion temperatures. The bond coat is an alloy containing sufficient Al, Cr and other active elements that encourage formation of a protective $\alpha$-$Al_2O_3$ scale during oxidation.

Unfortunately, the reliability and lifetimes of these coatings are limited by a number of factors:

(1) With increasing temperature above ~1100° C. and repeated thermal cycling, failure is caused by spalling, usually at the ceramic-metal interface between the $Al_2O_3$ layer and the bond coat. (7, 8, 22) The driving force for spalling comes from residual stresses in the $Al_2O_3$ coating, which result both from the difference in thermal expansion coefficient of $Al_2O_3$ (~$8\times10^{-6}$° C.$^{-1}$) and the superalloy (~12 to $16\times10^{-6}$° C.$^{-1}$), and from growth stresses thought to arise from oxidation of Al diffusing within the existing $Al_2O_3$ layer, (31, 18, 2) whereas the resistance to spalling is reduced by interface imperfections, both chemistry and topology, and associated fatigue and ratcheting of the underlying metal (7, 8).

(ii) Degradation by common fuel impurities, including sulfur, vanadium, and phosphorus. (14, 10) Vanadium causes destabilization of the Y-stabilized zirconia thermal barrier layer, and is of particular concern because of the cost of high grade fuel with low vanadium content.

(iii) Sintering and densification of the outer zirconia layer, which leads to increased thermal conductivity because of removal of fine-scale porosity and loss of the strain tolerance because of increased stiffness, and in the case of electron beam-physical vapor deposition (EB-PVD) coatings, bonding within the columnar microstructure.

The growth of the alumina layer is typically controlled by oxygen diffusion through the layer, with Al counter-diffusion playing a smaller but potentially important role. Reducing the growth rate implies reducing either the activity of aluminum on the bond coat side and/or of oxygen on the topcoat interface. The first option is risky because it can lead to de-stabilization of the alumina with concomitant loss of adhesion. The second option is not realistic because zirconia as a top layer poses no significant barrier to oxygen transport.

Alternative thermal barrier compounds with the potential to offer as low or lower conductivity than zirconia and improved resistance to fuel impurities or sintering are likely to be more complex oxides, containing two or more cations. Examples include $Gd_2Zr_2O_7$, which was recently developed (20). In recent research "La-hexaluminate" is among other candidates that are being explored. It can be difficult to maintain optimal stoichiometry between multiple cations during deposition of coatings of complex oxides.

Coatings for Ceramic Parts

Silicon-based ceramics (SiC and $Si_3N_4$) and their composites are also candidates for structural components for hot sections of heat engines and in heat exchangers. However, in these applications the exposure to combustion gases leads to life-limiting degradation in the temperature range 1200° C. to 1400° C., well below the temperature to which SiC is stable in less aggressive environments. Various corrosion mechanisms operate, depending on the composition of the combustion gases or impurities in the material.

Oxidation of pure silicon carbide normally leads to a protective scale layer of $SiO_2$. (12) However, the effectiveness of the protective layer is sensitive to environmental factors. In dry oxygen-containing environments the scale growth is limited by inward diffusion of oxygen through the scale, (24, 19, 34) with parabolic kinetics, i.e., decreasing oxidation rate with increasing time, and thus effective protection. The $SiO_2$ scale provides protection even in flowing gases, because the rate of oxygen diffusion in amorphous $SiO_2$ is low, and the viscosity remains high at temperatures close to the $SiO_2$ melting point (~1700° C.). (1) The upper functional temperature of the scale is determined either by reaction between the SiC substrate and the $SiO_2$ coating to form bubbles of gaseous CO at the interface, or by vaporization of SiO at the exposed surface (in fuel-rich environments). (12, 30, 13) Both mechanisms become significant at temperatures above ~1500° C.

In the presence of impurities that form low melting point silicates and low viscosity silicate glasses (e.g., boron commonly used as sintering aids in SiC materials or alkalis etc.), the protection offered by the oxide scale is reduced because of more rapid oxygen diffusion in the silicates and glasses. (10, 32, 3) The loss of protection is especially severe in flowing gases which remove the low viscosity silicates.

Furthermore, most combustion gases contain $H_2O$ vapor (~10% for combustion chambers of gas turbines) which leads to more rapid degradation than in dry $O_2$. (29, 25, 26) Water promotes crystallization of silicates, which potentially would retard oxygen diffusion but also promotes cracking. More importantly, $H_2O$ causes volatilization at the outer surface of the $SiO_2$ layer (with the possible formation of $Si(OH)_4$, $SiO(OH)_2$ or $Si_2O(OH)_6$). This leads to linear kinetics (i.e., the surface recession rate is controlled by the reaction rate for volatilization) and thus less protection over long times. This process is very sensitive to temperature and partial pressure of $H_2O$ but is not affected by impurities contained in the combustion gases.

Combustion gases also contain impurities, including sulfur, vanadium and alkali metals, that cause hot corrosion at substantially lower temperatures. For example, the presence of common salt (sodium chloride) can lead to the formation of $Na_2SO_4$, which when deposited on SiC causes degradation by dissolution and enhanced oxidation in the temperature range 900° C. to 1200° C. (i.e., between the melting point and the boiling point of the deposit). (12)

Approaches have been taken by others to extend the life of SiC components in combustion environments (see, 12, 17, 15, 9, 16, 27, 5). One approach is to develop protective coatings, either through improving the effectiveness of the $SiO_2$ scale that forms by oxidation or through depositing a more refractory coating. The second is to apply a thermal barrier coating to reduce the temperature at the SiC surface to less than about 1200° C. In this lower temperature range the oxidation rate is negligible (and at the same time hot corrosion by fuel and salt impurities is reduced. Refractory silicates based on celsian are currently used as a more refractory coating (5). Mullite coatings have also shown some protection, as long as the mullite is deposited in the crystalline form (17). However, excess alumina and other impurities in the mullite can lead to enhanced oxidation at temperatures above 1300° C. Especially damaging is the formation of voids at the $SiO_2$ layer that forms between the SiC and the mullite. Void formation is more severe in water-containing environments than in dry air. Void formation is thought to be due to oxidation of SiC at interface to form $SiO_2$ and CO, combined with reduced viscosity of the $SiO_2$ due to excess alumina and other impurities (15). The addition of a thermal barrier layer on top of the mullite may not directly affect the oxidation rate, but would reduce the temperature at the mullite/SiC interface.

SUMMARY OF THE INVENTION

Monazite and xenotime rare earth phosphates can be used to form thermal barrier coatings for high temperature applications. For example, lanthanum phosphate ($LaPO_4$ or La-monazite) coatings can be employed as thermal barrier coatings to protect superalloy and ceramic parts exposed to high temperature and corrosive atmospheres. These coatings are expected to be resistant to damage by sulfur, vanadium, phosphorus and other contaminants often found in such atmospheres which contaminants cause deterioration of the commonly used zirconium oxide (zirconia) thermal barrier coatings.

The monazite and xenotime coatings can be applied using any of the common application methods including electron beam-physical vapor deposition (EB-PVD), laser ablation and plasma spraying. The stoichiometry of the $LaPO_4$ can be somewhat difficult to control in deposition methods that involve melting, because of preferential evaporation of P. In particular, the deposited coating may show a deficiency of phosphate relative to lanthanum as compared to a stoichiometric $LaPO_4$ starting material. The stoichiometry can be modulated according to the stoichiometry of the specially prepared starting target (source) material. Ideally, fresh target material is constantly exposed to the evaporating means (e.g., laser or electron beam) so that the melt stoichiometry is not changed by differential loss of some of the components. Use of a pulsed electron beam for ablation shows special advantages in controlling stoichiometry.

The structure of the deposited coating is strongly influenced by the temperature of the substrate during deposition. Coatings deposited at lower temperatures (approximately 0.45 of the melting temperature) were glassy or showed botryoidal clusters forming a porous structure. Exposure of such coatings to higher temperature results in increased crystallinity without showing significantly improved resistance to spalling. The most effective coatings are largely crystalline and show a columnar structure with feather-like microstructure. Although there is some interaction between deposition method and optimum substrate temperature, the preferred coatings were deposited on substrates of intermediate temperature (about 0.48 melting temperature).

DETAILED DESCRIPTION OF THE INVENTION

Figure 1:
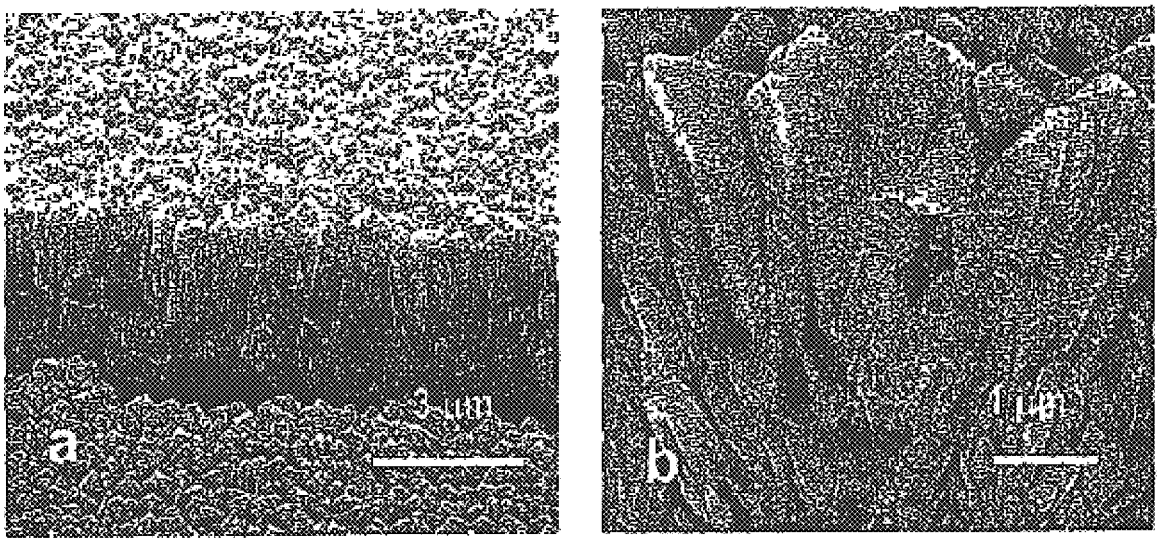
FIG. 1*a* shows a scanning electron micrographs of a coating deposited at 860° C. showing both the surface and a fracture face.
FIG. 1*b* shows a scanning electron micrographs of the coating of FIG. 1*a* illustrating details of the fracture face showing a columnar structure with feather-like features.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a thermal barrier coating based on rare earth phosphates.

Rare-Earth Phosphates

Rare-earth phosphates have a combination of properties (high temperature stability, compatibility, thermal conductivity, and corrosion resistance) that make them of use for thermal barrier coatings. These materials show thermal conductivity and thermal expansion coefficients similar to zirconia (23, 11). Two series of rare earth phosphates are useful in the present invention. Monazites form a family of materials of the general formula MP04 where M represents any of larger trivalent elements of the lanthanide series (La, Ce, Pr, Nd, Pm, Sm, Eu, Gd, and Tb). Xenotimes are analogous phosphates of the general formula $XPO_4$ where X is selected from Sc, Y and any of the smaller trivalent elements of the lanthanide series (Dy, Ho, Er, Tm, Yb, and Lu). It is expected that these compounds will show similar properties as thermal barrier coatings.

We have experimented with La-monazite as a test material. This compound (as well as the other listed rare earth phosphates) is less susceptible than zirconia to high temperature corrosion in environments containing sulfur, vanadium or phosphorus. This comes about largely because the strongly basic trivalent rare earth is bonded to the strongly acidic phosphate, forming a low free energy compound with the preferred simple valence balance that leads also to good crystal packing. Weaker acids and bases have little chance of reacting with this compound. La-monazite is also stable to very high temperatures and compatible with many simple oxides. It is well known in rare-earth chemistry that there are very gradual changes as one moves along the rare-earth series with increasing atomic weight. We concentrate here on La phosphates as probably the most desirable contender in several ways (highest melting, lightest etc). We do not intend to preclude other rare earths or their combinations (e.g., La and Ce) which also show some usefulness.

$LaPO_4$ has many of the attributes that make the commonly used zirconia desirable as a thermal barrier material. $LaPO_4$ is refractory with low thermal conductivity (approximately 1.8 W/m·K at 700° C.), high thermal expansion coefficient ($9–10\times10^{-6}$/K), and low Young's modulus (133 GPa). Although stoichiometric $LaPO_4$ does not react with alumina (a favorable characteristic), it also does not bond effectively to alumina. As shown below, we altered the stoichiometry of the $LaPO_4$ or introduced interphase material to overcome this apparent shortcoming. $LaPO_4$ can be deposited in crystalline form on a heated substrate using conventional or pulsed electron beam vapor deposition and laser ablation, although those deposition techniques may not allow optimum control of coating composition. The deposition conditions used for electron beam vapor deposition can be adjusted to achieve a crystalline columnar microstructure, as in FIG. 1*b*, thereby mimicking the strain-tolerant microstructure of current state-of-the-art $ZrO_2$ coatings. $LaPO_4$ and closely related compounds are alternatives to $ZrO_2$ for thermal barrier coatings for metal alloy parts.

An important feature is the use of rare-earth element deposition sources with controlled compositions. Targets for pulsed electron beam ablation are fabricated by sintering the monazite powder and mixtures of the monazite powder, other rare-earth element phosphates, and refractory oxides, such as zirconia, alumina, and mullite, and Y and La aluminates. Microstructures of the resulting coatings can then be assessed using X-ray diffraction and analytical scanning electron microscopy. Control of the La:P ratio in powders used to form the target is especially critical. However control of the La:P ratio requires special techniques: precipitation of powders from precursor solutions generally results in a P-rich composition that requires further careful processing to adjust to the desired composition. That is, targets contain either rare-earth phosphates or mixtures of rare-earth element precursors (rare-earth element compounds that provide a rare-earth on evaporation) and phosphorus precursors (phosphorus containing compounds that provide phosphorous on evaporation). This approach simplifies the production of rare-earth element phosphate coating containing mixtures of several different rare-earth elements. In particular, we have found that coating containing mixtures of La, Ce and Nd phosphates show especially favorable properties.

Optimum properties are achieved with coatings having varying microstructures or two-phase compositions. A dual-layer coating with a thin dense layer of $LaPO_4$ (rare-earth element phosphate) adjacent to the pre-oxidized $Al_2O_3$, and a thicker columnar layer for thermal insulation and strain accommodation results in reduced growth rate of the $Al_2O_3$ layer and thus reduced residual stresses in the oxygen barrier layer ($Al_2O_3$+$LaPO_4$ or rare-earth element phosphate). It is also beneficial to intercalate a layer of an aluminum phosphate between the rare-earth phosphate layer and the alumina. Alternatively, the aluminum phosphate can replace the alumina layer. Another preferred configuration uses a crack-free layer of $LaAlO_3$ (or rare-earth aluminum oxide) between the $Al_2O_3$ and $LaPO_4$ (or rare-earth element phosphate). The thermal expansion coefficient of $LaAlO_3$ ($9.2\times10^{6}$° C.−1) lies between those of $Al_2O_3$ and $LaPO_4$, and, as with $LaPO_4$, the oxygen diffusion is much lower than in $ZrO_2$. We have also shown that the bonding of $LaAlO_3$ to $LaPO_4$ and $Al_2O_3$ is stronger than the bonding of $LaPO_4$ to A103, thus allowing a more strongly bonded coating system. The $LaAlO_3$ layer can be formed by separately depositing the $LaAlO_3$, or it can be formed via an in situ reaction after depositing a coating of $LaPO_4$ with excess La onto the pre-oxidized substrate. The range of substrate temperatures needed for optimum deposition has been defined below. Substrates of pre-oxidized FeCrAlY, with composition similar to that of bond coats typically used on Ni-based superalloys, has been be used to allow direct comparison of coating properties, such as lifetime under thermal cycling, with existing $ZrO_2$ coatings.

Coating Techniques

8temperature coatings are most commonly formed by plasma spraying or vapor phase (physical or chemical) deposition techniques. These methods have two advantages: they use a transient, high-energy form (e.g., melt, vapor) of the material to be deposited and the coating is deposited using small building blocks that land on the surface. The energy stored in these blocks is sufficient to evolve locally towards the final microstructure. When additional energy is required, the substrate temperature can be increased. For example, $ZrO_2$ thermal barrier coatings are produced either by plasma spraying or EB-PVD. These coatings are relatively stable, although the fine-scale porosity that is introduced to reduce the thermal conductivity leads to coatings with high surface areas that are prone to sintering.

Although these techniques are suitable for manufacturing some coatings, they may not be adequate to screen and investigate new compositions. They usually require large quantities of target material with low deposition yield and they are usually not available on a small scale. In addition, complex compositions with two or more compounds require considerable optimization to achieve the desired composition and microstructure. Compounds with constituents having different vapor pressures are especially difficult to deposit by techniques such as EB-PVD that involve melting and evaporation. In the electronics industry, the laser ablation technique has been used successfully with small targets and complex compositions. However, the effectiveness of the technique is reduced in materials that are partially transparent (or reflective) at the laser wavelength. The higher beam power required and larger volume of target heated increase the likelihood of melting rather than ablation, with loss of high vapor pressure species.

We have deposited coatings of $LaPO_4$ by either laser ablation or electron beam evaporation (EB-PVD), onto substrates of FeCrAlY of composition similar to that of bond coats typically used on Ni-based superalloys.

We found that substrate temperature plays a central role in determining the morphology and crystal structure of physically evaporated materials. Microstructures of coatings formed on substrates held with three temperature ranges are described below.

Low Temperature Coatings (600° C.–700° C.)

Coatings deposited at low temperatures appear to be glassy. X-ray diffraction showed poorly crystalline structures, with a dominant broad peak at approximately 28°. The position of the peak does not correspond to the major peaks of $LaPO_4$. Further characterization by Raman spectroscopy confirmed this difference. Additional X-ray diffraction data on other more crystalline low temperature coatings suggest a structure closer to that of $AlPO_4$, which is suggestive of a metastable form of $LaPO_4$ quenched on the substrate. Upon heat-treatment at 900° C. the coatings spalled from the substrate, with debonding occurring between the coating and a thermally grown alumina layer, presumably driven by the volume change associated with crystallization.

Intermediate Temperature Coatings (750–850° C.)

Coatings deposited at intermediate temperatures consist of adjacent botryoidal clusters forming a porous structure. X-ray diffraction indicates a more crystalline structure with a large proportion of monazite. A major peak at 28° and other extraneous peaks also suggest the presence of the hypothesized metastable form of lanthanum phosphate and possibly other phases. Raman spectroscopy confirmed the presence of the monazite but also showed at least one extraneous peak. After heat treatment at 900° C. and 1100° C. for one hour, the coating transformed completely to monazite, and all the extraneous peaks disappeared. These coating did not show any sign of spalling even after quenching in air from 1100° C.

When the target was rotated at the low-end of the substrate temperature range, the coatings were dense with a botryoidal microstructure at the surface consistent with previous observations. With the deposition conditions being stable, coating thicknesses of more than 20 $\mu$m were achieved.

FIGS. 1*a* and 1*b* shows that the coatings deposited at 860° C. on rotated substrates were crystalline and exhibited a columnar shape similar to $ZrO_2$-based thermal barrier coatings. The tips of the columns had mostly four-sided pyramidal shapes as shown in the surface portion of FIG. 1*a*. The coating appeared to grow first as a dense layer that subsequently developed into the columnar structure, with columns growing mostly vertically. This can be seen on the fracture face of FIG. 1*a*. The columns exhibited also a feather-like microstructure that is thought to decrease thermal conductivity which structure can be seen more clearly in FIG. 1*b*.

High Temperature Coatings (900–1100° C.)

Coatings deposited at higher temperatures demonstrated well crystallized monazite, with grain size between 0.5 and 10/m. A thin layer of $LaAlO_3$ between the $LaPO_4$ and the thermally grown alumina was also identified, suggesting that the initial deposition was La-rich (this is a desirable microstructure because we found that $LaPO_4$ bonds more strongly to $LaAlO_3$ than to $Al_2O_3$). The $LaPO_4$ grains were equiaxial with mostly faceted surfaces.

Laser Ablation Coatings

Figure 2:
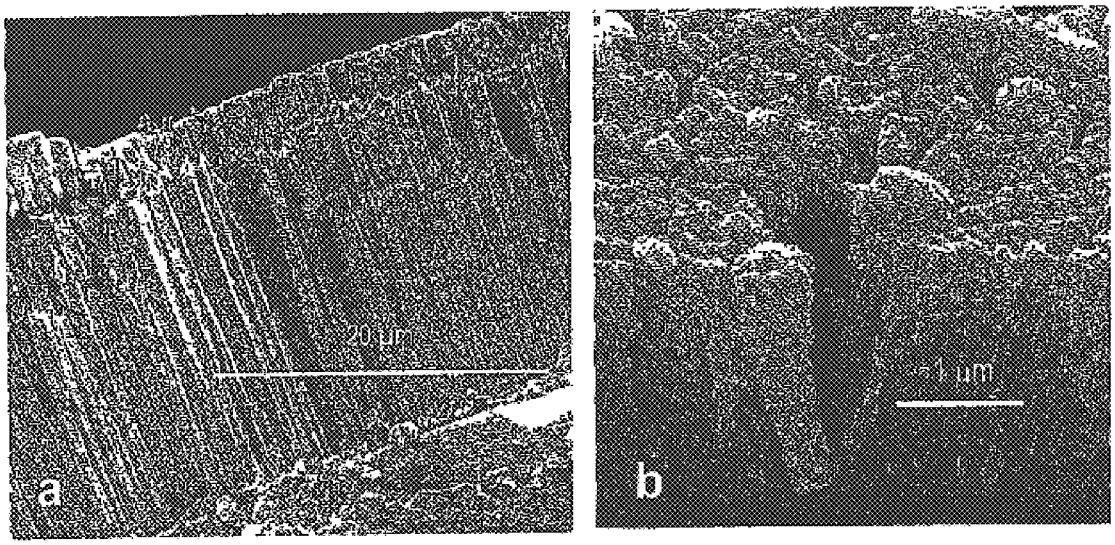
FIG. 2*a* shows a thick $LaPO_4$ coating, showing columnar structure, deposited on sapphire at room temperature by laser ablation.
FIG. 2*b* shows a thin $LaPO_4$ coating deposited on sapphire at −800° C. by laser ablation and subsequently annealed at 1100° C.

The microstructures of the coatings deposited by laser ablation did not exactly match those obtained by EB-PVD at the same deposition temperatures. At low temperature, the coatings were poorly crystallized and often exhibited a well-defined columnar microstructure, which can be seen in FIG. 2*a*. At 740° C. (~$0.43T_M$), the coating was relatively dense and the X-ray diffraction pattern was similar to that of EB-PVD coatings deposited at low temperature We defined deposition conditions under which crystalline columnar coatings were obtained (similar to FIG. 1*b*), with structures similar to EB-PVD $ZrO_2$ coatings known to have high strain tolerance. However, some difficulty was encountered in controlling the composition, specifically the La:P ratio, during deposition of such thick coatings. The difficulty in controlling composition is intrinsic to the deposition methods used, which involved melting and evaporation. Monazite is a line compound that melts congruently. In addition, $La_2O_3$ and P205 have very different melting points (i.e., 2070° C. and 540° C., respectively) and their thermal decomposition leads to species having very different partial pressures above their respective oxides at a given temperature. At sufficiently high temperature, the evaporation of LaO(g) and $PO_2$(g) species from solid stoichiometric $LaPO_4$ would be expected to occur simultaneously. Remedies to this issue are well identified in the art of coating. Complementary techniques using EB-PV deposition include the use of multiple crucibles, off-stoichiometry targets or assistance of gaseous jet to collimate the vapor. In the case of plasma-sprayed coatings, laser or pulsed electron beam ablation, off-stoichiometry target compositions would address this issue.

The following claims are thus to be understood to include what is specifically illustrated and described above, what is conceptually equivalent, what can be obviously substituted and also what incorporates the essential idea of the invention. Those skilled in the art will appreciate that various adaptations and modifications of the just-described preferred embodiment can be configured without departing from the scope of the invention. For example, various rare earths and their combinations may be substituted, and sequential combinations of heat treatments could be employed. The illustrated embodiment has been set forth only for the purposes of example and that should not be taken as limiting the invention. Therefore, it is to be understood that, within the scope of the appended claims, the invention may be practiced other than as specifically described herein.

5.0 REFERENCES

1. Cawley, J. D. and R. F. Handschuh, Phenomenological Study of the Behavior of some Silica Formersin a High Velocity Jet Fuel Burner. Cleveland, Ohio, NASA Lewis Research Center (1985).
2. Christensen, R., D. M. Lipkin, D. R. Clarke and K. Murphy, "Non-Destructive Evaluation of Oxidation Stresses Through Thermal Barrier Coatings Using Cr3+ Piezospectroscopy," *Applied Physics Letters,* 69[24] 3754–3756(1996).
3. Costello, J. A., R. E. Tressler and S. T. Tsong, "Boron Redistribution in Sintered α-SiC During Thermal Oxidation," *J. Am. Ceram. Soc.,* 641[6] 332–35 (1981).
4. DeMasi-Marcin, J. T. and D. K. Gupta, "Protective Coatings In the Gas Turbine Engine," *Surface and Coatings Technology,* [68/69] 1–9 (1994).
5. Eaton, H. E., C. T Woodstock, T. H Lawton, C. T Wethersfield, "Method for Applying a Barrier Layer to a Silicon based Substrate," U.S. Pat. No. 6,254,935 (2001)
6. Eaton, H. E. and R. C. Novak, "Alumina-CoCrAlY Material as an Improved Intermediate Layer for Graded Ceramic Gas-Pat Sealing in Aeroturbine Engines," *Ceram. Engineering Science Proc.,* 7[7–8] 727 (1986).
7. Evans, A, G., D. R. Mumm, J. W. Hutchinson, G. H. Meier, and F. S. Pettit, "Mechanisms Controlling the Durability of Thermal Barrier Coatings," Progress in Materials Science 46 505–553 (2001)
8. Evans, A. G., M. Y. He and J. W. Hutchinson, "Effect of Interface Undulations on the Thermal Fatigue of Thin Films and Scales on Metal Substrates," *Acta Materialia,* 45[9] 3543–3554 (1997).

9. Federer, J. I., "Alumina Base Coatings for Protection of SiC Ceramics," *J. Mater. Eng.,* 12[2] 141–49 (1990).
10. Hamilton, J. C. and A. S. Nagelberg, "In Situ Spectroscopic Study of Yttria-Stabilized Zirconia Attack by Molten Sodium Vanadate," *J. Am. Ceram. Soc.,* 67[10] 686–690 (1984).
11. Hikichi, Y., T. Nomura, Y. Tanimura and S. Suzuki, "Sintering and Properties of Monazite-type $CePO_4$," *J. Am. Ceram. Soc.,* 73[12] 3594–3596 (1990).
12. Jacobson, N., "Corrosion of Silicon-Based Ceramics in Combustion Environments," *J. Am. Ceram. Soc.,* 76[1] 3–28 (1993).
13. Jacobson, N. S., K. N. Lee and D. S. Fox, "Reactions of SiC and $SiO_2$ at Elevated Temperature," *J. Am. Ceram. Soc.,* 75[6] 1603–11 (1992).
14. Jones, R. L. and C. E. Williams, "Hot Corrosion Studies of Zirconia Ceramics," *Surface Coatings Technology,* 32 349–358 (1987).
15. Lee, K. N. and R. A. Miller, "Oxidation Behavior of Mullite-Coated SiC and SiC/SiC Composites under Thermal Cycling between Room Temperature and 1200°–1400° C.," *J. Am. Ceram. Soc.,* 79[3] 620–26 (1996).
16. Lee, K. N. and R. A. Miller, "Thermal Barrier Coatings," 1997.
17. Lee, K. N., R. A. Miller and N. S. Jacobson, "New Generation of Plasma-Sprayed Mullite Coatings on Silicon Carbide," *J. Am. Ceram. Soc.,* 78[3] 705–10 (1995).
18. Lipkin, D. M. and D. R. Clarke, "Measurement of the Stress in Oxide Scales Formed by Oxidation of Aluminum-Containing Alloys," *Oxidation of Metals,* 45[3/4] 267–280 (1996).
19. Luthra, K. L., "Some New Perspectives on Oxidation of Silicon Carbide and Silicon Nitride," *J. Am. Ceram. Soc.,* 74[5] 1095–103 (1991).
20. Maloney, M. J., "Thermal Barrier Coating Systems and Materials," U.S. Pat. No. 6,284,323 (2001).
21. Meier, S. M., D. K. Gupta and K. Sheffler, "Ceramic Thermal Barrier Coatings for Commercial Gas Turbine Engines," *J. Met.,* 43[3] 50 (1991).
22. Miller, R. A. and C. C. Berndt, "The Performance of Thermal Barrier Coatings in High Heat Flux Environments," *Thin Solid Films,* (1984).
23. Morgan, P. E. D. and D. B. Marshall, "Ceramic Composites of Monazite and Alumina," *J. Am. Ceram. Soc,* 78[6] 1553–63 (1995).
24. Motzfield, K., "On the Rates of Oxidation of Silicon and Silicon Carbide is Oxygen and Correlation with Permeability of Silica Glass," *Acta Chem Scand.,* 18[7] 1596–606 (1964).
25. Opila, E. J., J. L. Smialek, R. C. Robinson, D. S. Fox, N. S. Jacobson: SiC Recession Caused by $SiO_2$ Scale Volatility Under Combustion Conditions: II, Thermodynamics and Gaseous Diffusion Model. *J. Am. Ceram. Soc.* 1999, 82:1826–34.
26. Opila, E. J. and R. E. J. Hann, "Paralinear Oxidation of CVD SiC in Water Vapor," *J. Am. Ceram. Soc.,* 80[1] 197–205 (1997).
27. Price, J. R., M. van Roode and C. Stala, "Ceramic Oxide-Coated Silicon Carbide for High Temperature Corrosive Environments," *Key Eng. Mater.,* 72–74 71–84 (1992).
28. "Proceedings of the 1995 Thermal Barrier Coatings Workshop," NASA conference publication 3312, 1995.
29. Robinson, R. C., J. L. Smialek: SiC Recession Caused by $SiO_2$ Scale Volatility Under Combustion Conditions: I, Experimental Results and Empirical Model. *J. Am. Ceram. Soc.* 1999, 82:1817–25.
30. Schiroky, G. H., R. J. Price and J. E. Sheehan, Oxidation Characteristic of CVD Silicon Carbide and Silicon Nitride. *G A Technologies Inc.* San Diego (1986).
31. Sims, C. T., N. S. Stoloff and W. C. Hagel, *Superalloys II*. New York, John Wiley & Sons (1987).
32. Singhal, S. C. and F. F. Lange, "Effect of Alumina Content on the Oxidation of Hot Pressed Silicon Carbide," *J. Am. Ceram. Soc.,* 58[9–10] 433–35 (1975).
33. Takahashi, M., Y. Itoh and M. Miyazaki, "Thermal Barrier Coatings Design for Gas Turbines," pp 83–88 proc High Temperature Society of Japan, Yokohama 230, Japan, 1995.
34. Zheng, Z., R. E. Tressler and K. E. Spear, "Oxidation of Single-Crystal Silicon Carbide, Part I, Experimental Studies," *J. Electrochem. Soc.,* 137[3] 854–58 (1990).

We claim:

1. A thermal barrier coating comprising a layer of rare-earth element phosphate said layer having a thickness greater than about 20 micrometers, a thermal conductivity less than about 2 W/mK and disposed on an exterior surface of one of a ceramic substrate and a metallic substrate selected from the group consisting of a nickel-based superalloy, an iron-based superalloy and a cobalt-based superalloy so as to thermally protect the substrate, and further comprising a layer of aluminum phosphate disposed between the layer of rare-earth element phosphate and the substrate.

2. The thermal barrier coating according to claim 1 further comprising a monazite or xenotime crystal structure.

3. The thermal barrier coating according to claim 1, wherein the ratio between rare-earth element and phosphate is about 1:1.

4. The thermal barrier coating according to claim 1, wherein the layer has a thickness between about 20 and 500 micrometers.

5. The thermal barrier coating according to claim 1 deposited on a substrate having a temperature between 600° C. and 1100° C.

6. The thermal barrier coating according to claim 5 deposited on a substrate having a temperature between 750° C. and 950° C.

7. The thermal barrier coating according to claim 1 formed by a process selected from the group consisting of chemical vapor deposition, physical vapor deposition, electron beam evaporation, pulsed electron beam evaporation, laser ablation, and plasma spraying.

8. The thermal barrier coating according to claim 7 using single or multiple sources of materials selected from the group consisting of rare-earth phosphates and mixtures of rare-earth precursors with phosphorous precursors.

9. The thermal barrier coating according to claim 1 formed with a columnar microstructure.

10. The thermal barrier coating according to claim 1 formed with a porous microstructure.

11. The thermal barrier coating according to claim 1, wherein the phosphate is lanthanum phosphate.

12. The thermal barrier coating according to claim 1 further comprising a layer of alumina between the metallic substrate and said rare-earth element phosphate.

13. The thermal barrier coating according to claim 12 further comprising a region of rare-earth aluminate between the alumina and said rare-earth element phosphate.

14. A thermal barrier coating comprising a layer of comprising a mixture of lanthanum phosphate, cerium phosphate and neodymium phosphate rare-earth element phosphate said layer having a thickness greater than about 20 micrometers, a thermal conductivity less than about 2 W/mK and disposed on an exterior surface of a substrate so as to thermally protect the substrate.

15. A thermal barrier coating comprising a layer of lanthanum phosphate said layer having a thickness greater than about 20 micrometer and disposed on an exterior surface of one of a ceramic substrate and a metallic substrate selected from the group consisting of a nickel-based superalloy, an iron-based superalloy and a cobalt-based superalloy so as to thermally protect the substrate, and further comprising a layer of aluminum phosphate disposed between the layer of lanthanum phosphate and the substrate.

16. The thermal barrier coating according to claim 15 further comprising a monazite crystal structure.

17. The thermal barrier coating according to claim 15, wherein the ratio between lanthanum and phosphate is about 1:1.

18. The thermal barrier coating according to claim 15, wherein the layer has a thickness between about 20 and 500 micrometers.

19. The thermal barrier coating according to claim 15 deposited on a substrate having a temperature between 600° C. and 1100° C.

20. The thermal barrier coating according to claim 19 deposited on a substrate having a temperature between 750° C. and 950° C.

21. The thermal barrier coating according to claim 15 formed by a process selected from the group consisting of chemical vapor deposition, physical vapor deposition, electron beam evaporation, pulsed electron beam evaporation, laser ablation, and plasma spraying.

22. The thermal barrier coating according to claim 21 using single or multiple sources of materials selected from the group consisting of rare-earth phosphates and mixtures of rare-earth precursors with phosphorous precursors.

23. The thermal barrier coating according to claim 15 formed with a columnar microstructure.

24. The thermal barrier coating according to claim 15 formed with a porous microstructure.

25. The thermal barrier coating according to claim 15 further comprising a layer of alumina between the metallic substrate and the lanthanum phosphate.

26. The thermal barrier coating according to claim 25 further comprising a region of lanthanum aluminate between the alumina and the lanthanum phosphate.

27. A thermal barrier coating comprising a layer of a mixture of lanthanum phosphate, cerium phosphate and neodymium phosphate lanthanum phosphate said layer having a thickness greater than about 20 micrometer and disposed on an exterior surface of a substrate so as to thermally protect the substrate.

28. A thermal barrier coating comprising a layer of a mixture of rare-earth element phosphates and refractory oxides said layer having a thickness greater than about 20 micrometers, a thermal conductivity less than about 2 W/mK and disposed on an exterior surface of one of a ceramic substrate and a metallic substrate selected from the group consisting of a nickel-based superalloy, an iron-based superalloy and a cobalt-based superalloy so as to thermally protect the substrate, and further comprising a layer of aluminum phosphate disposed between the mixture and the substrate.

29. The thermal barrier coating according to claim 28, wherein the layer has a thickness between about 20 and 500 micrometers.

30. The thermal barrier coating according to claim 28 deposited on a substrate having a temperature between 600° C. and 1100° C.

31. The thermal barrier coating according to claim 28 formed by a process selected from the group consisting of chemical vapor deposition, physical vapor deposition, electron beam evaporation, pulsed electron beam evaporation, laser ablation, and plasma spraying.

32. The thermal barrier coating according to claim 28 formed with a columnar microstructure.

33. The thermal barrier coating according to claim 28 formed with a porous microstructure.

34. A thermal barrier coating comprising a layer of a mixture of rare-earth element phosphates and refractory oxides said layer having a thickness greater than about 20 micrometers, a thermal conductivity less than about 2 W/mK and disposed on an exterior surface of a substrate so as to thermally protect the substrate further comprising a layer of alumina between the substrate and the mixture.

35. The thermal barrier coating according to claim 34 further comprising a region of rare-earth aluminate between the alumina and said rare-earth element phosphates.

* * * * *